United States Patent [19]

Hoet

[11] 4,387,320

[45] Jun. 7, 1983

[54] ELECTRON TUBE WITH CYLINDRICAL GRID OF PYROLYTIC GRAPHITE

[75] Inventor: Roger Hoet, Paris, France

[73] Assignee: Thomson - CSF, Paris, France

[21] Appl. No.: 250,923

[22] Filed: Apr. 6, 1981

Related U.S. Application Data

[63] Continuation of Ser. No. 58,981, Jul. 20, 1979.

[30] Foreign Application Priority Data

Jul. 27, 1978 [FR] France ..... 78 22265

[51] Int. Cl.[3] ..... H01J 1/46; H01J 17/04; H01J 17/40; H01J 21/10

[52] U.S. Cl. ..... 313/348; 313/293

[58] Field of Search ..... 313/293, 348

[56] References Cited

U.S. PATENT DOCUMENTS

| | | | |
|---|---|---|---|
| 3,164,740 | 1/1965 | Moscony et al. | 313/348 |
| 3,307,063 | 2/1967 | Sarrois | 313/348 |
| 3,995,188 | 11/1976 | Gerlach et al. | 313/348 |
| 4,119,880 | 10/1978 | Wilcox et al. | 313/348 |
| 4,229,674 | 10/1980 | Hoet | 313/348 |
| 4,302,701 | 11/1981 | Beling | 313/348 |

*Primary Examiner*—Saxfield Chatmon, Jr.
*Attorney, Agent, or Firm*—Roland Plottel

[57] ABSTRACT

In an electron tube having coaxial cylindrical electrodes and at least one cylindrical grid of pyrolytic graphite, the grid is joined to the upper portion of a central conducting mast by means of a bell which is also of pyrolytic graphite and fixed on the mast. Slits are cut at uniform intervals around the periphery of the bell in order to form resilient strips which serve to establish an electrical contact between the grid and the conducting mast.

2 Claims, 5 Drawing Figures

ELECTRON TUBE WITH CYLINDRICAL GRID OF PYROLYTIC GRAPHITE

This application is a continuation of application Ser. No. 58,981, filed July 20, 1979.

This invention relates to an electron tube having coaxial cylindrical electrodes and comprising at least one grid of pyrolytic graphite.

The invention is primarily concerned with the assembly of a grid of this type, not only when provision is made for an electrical connection from the base stem of the tube to the lower end of the grid, but also when it proves necessary to have a second electrical connection to the upper end of the grid, especially in order to permit a "grounded cathode" tube assembly in accordance with the arrangement described in U.S. Pat. No. 3,742,292 in which the upper end of the grid is connected to a central conductor or "mast" which passes through the electrodes.

Grids of pyrolytic graphite (also known as oriented graphite) have already been described, especially in a number of patents filed in the name of the present Applicant, for example in U.S. Pat. No. 3,535,758 and in U.S. Pat. No. 3,307,063.

The assembly and attachment of said grids have formed the subject of a patent application filed by the present Applicant on June 23rd, 1978 under No 78 18 834 relating to a method for solving mechanical problems, thermal problems (differences in expansion of the grid and of the base stem in particular) as well as electrical problems when the grid is only required to have a single electrical connection or in other words when a tube assembly of the so-called "grounded grid" type is considered sufficient.

However, when it is found necessary in the case of pyrolytic graphite grids to adopt a tube assembly of the above-mentioned type consisting of a grounded cathode and central conductor in order to increase the power gain of the tube, for example, the connection of the grid to the upper end of said conductor (which passes through the base stem at the opposite or lower end) presents a problem which is similar to that of attachment of the grid to the base stem. Said connection must make it possible to absorb differences in expansion between the grid and the central conductor; such differences can be considerable if the mast is of metal (molybdenum, for example). Both longitudinal and transverse stresses must be avoided since they would give rise to deformations and eccentric displacement of the grid.

In accordance with the invention, the central conducting mast is in contact with the grid by means of a series of graphite strips uniformly distributed on a circular periphery. The top end of the mast may be adapted to carry a conducting disc of metal or of graphite.

In more exact terms, electron tubes of the type comprising cylindrical electrodes and a central mast in accordance with the invention in which a grid of pyrolytic graphite is connected to one end of said central mast, are characterized by the combination of a circular opening at the top portion of the grid with a series of graphite strips which may or may not be integral with the grid and through which a contact is established between the mast and the top portion of the grid body.

In a preferred embodiment of the invention which makes it possible to employ a one-piece grid of pyrolytic graphite which has been subjected to standard machining, the aforementioned series of graphite strips is formed on the periphery of the conical skirt of a flat-bottomed bell of pyrolytic graphite; the bottom portion of the bell is fixed on the mast or on the disc which is preferably of metal and in turn fixed on the top end of the mast, and the grid is then lowered onto the bell, the diameter of the top hole of the grid being comprised between the minimum and maximum diameters of the bell.

In a further embodiment of the invention, the strips are formed at the top of the grid itself and said grid accordingly has a conical upper portion which bears directly on the disc, said disc being preferably also formed of pyrolytic graphite in such a case.

In all cases, the grid-mast contact, whether direct or not, is a uniformly distributed contact which readily accommodates the differences in expansion between these two elements at the operating temperature.

By way of example, the attachment of the grid and the electrical connection at the other end of said grid or in other words at the lower end are advantageously carried out in the manner indicated in the patent Application cited earlier.

A more complete understanding of the invention will be gained from the following description and from the accompanying drawings, in which.

Figure 1:
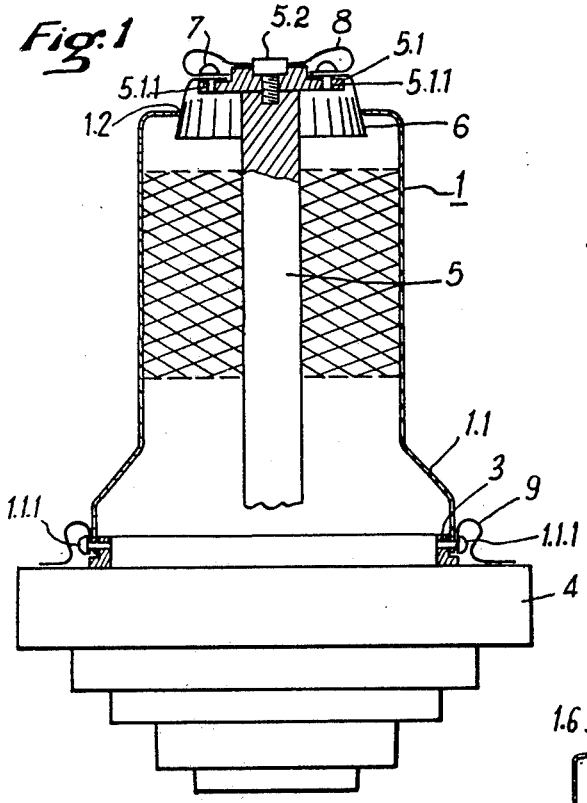
FIG. 1 is a schematic axial sectional view of a first exemplified embodiment of the invention.

In the schematic vertical sectional view of FIG. 1, the reference numeral 1 designates a grid of pyrolytic graphite connected in accordance with the invention to the top portion of the conducting mast 5.

The grid is provided at the lower end thereof with a sleeve 1.1. which is fitted onto the metal ring 3, said ring being in turn mounted on the base 4 of the electron tube. All details relating to machining and attachment of this portion of the grid have purposely been omitted from the description since they have no direct bearing on the invention.

A precision-bored central hole 1.2. is formed at the top end of the grid.

A metal disc 5.1. having an external diameter which is smaller than that of the central hole of the grid is fixed on the top end of the central mast 5. Said disc is provided with a series of internally-threaded holes 5.1.1.

Figure 2:
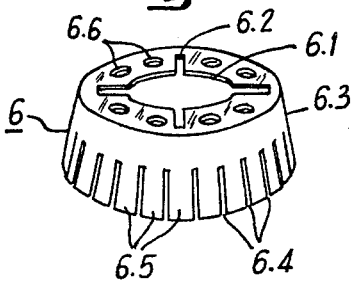
FIG. 2 is an enlarged view of one of the elements of FIG. 1.
Figure 3:
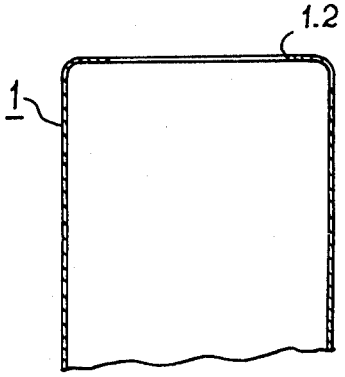
FIG. 3 is a sectional view of the upper portion of the grid of FIG. 1.

A flat-bottomed bell 6 of pyrolytic graphite which is illustrated to a larger scale in FIG. 2 is mounted on the disc 5.1. The bottom or end-wall of the bell is provided with a circular hole 6.1. for engaging the bell on the disc 5.1. Expansion slots 6.2. are formed in the end-wall of said disc and are four in number in the example shown. The skirt 6.3. of the frusto-conical bell has slits 6.4. which are uniformly distributed on its periphery and define a series of strips 6.5. The diameter of the top hole of the grid is comprised between the minimum and maximum diameters of the conical skirt as shown in detail in FIG. 3. The grid is lowered onto the bell and resiliently applied against this latter by means of the strips 6.5., thereby closing said strips to a slight extent without any attendant danger of sticking or sintering since a graphite-to-graphite contact is thus established.

The bell is also provided with holes 6.6. for fixing on the disc 5.1., the fixing screws being shown at 7. In the example considered, shunts shown in the figure at 8 are constituted by strips of tantalum secured at one end beneath the heads of the screws 7 and soldered to the mast at the other end.

The assembly can be completed by means of shunts 9 which are similar to the shunts 8. On the one hand, said shunts 9 are soldered to the base 4 and on the other hand are clamped beneath the screws 1.1.1. for fixing the grid on the ring 3, in accordance with an arrangement which is in any case already known.

Figure 4:
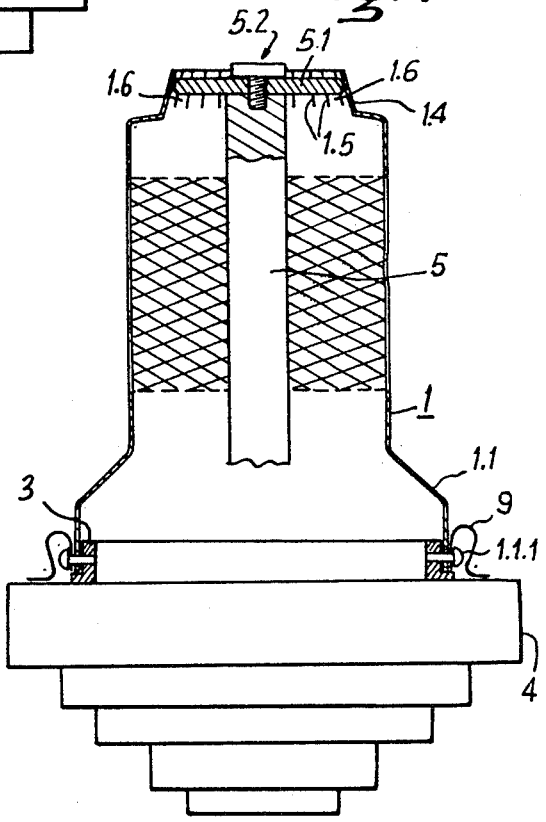
FIG. 4 is a schematic axial sectional view of a second exemplified embodiment of the invention.

In the alternative embodiment of the invention shown in FIG. 4, in which the same elements as in FIG. 1 are designated by the same references, the upper portion of the grid is given the shape of a conical skirt 1.4. divided into small strips 1.6. by means of slits 1.5.; in this alternative embodiment, the disc 5.1. is preferably of graphite and has rounded edges.

This assembly has the same advantages as in the previous embodiment and is more simple but calls for special machining of the grid in order to form the small strips 1.6. The reference 5.2. designates a central screw for fixing the graphite disc 5.1. on the mast 5.

Figure 5:
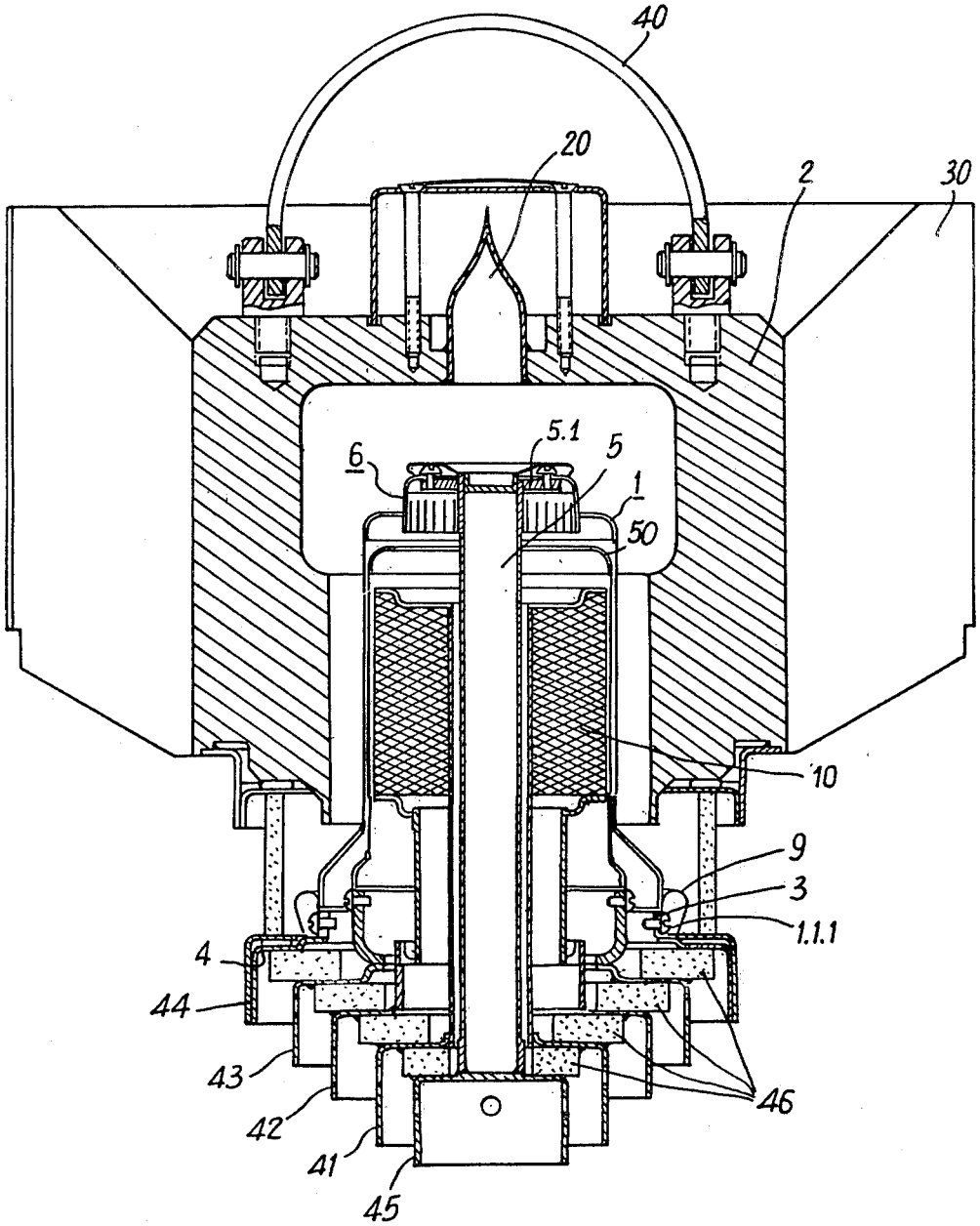
FIG. 5 is a general sectional view of an electron tube comprising a grid of the type shown in FIG. 1.

FIG. 5 is a general sectional view of an electron tube having four electrodes or tetrodes and a screen grid 1 mounted as in the alternative embodiment of FIG. 1.

The elements described earlier are again shown in the figure and designated by the same reference numerals. There are shown in addition the cathode designated by the reference 10, a first control grid placed within the grid 1 and designated by the reference 50, the anode designated by the reference 2 and the exhaust tube 20 of the vacuum envelope. The lower portion of the figure also shows the metal cups 41 to 45 for connecting the different electrodes to the voltage sources (not shown) which supply said electrodes, said cups being isolated from each other by means of spacing blocks 46 of insulating material. The references 30 and 40 designate respectively a radiator and a protective cover.

By way of non-limitative example, a grid having a height of 200 mm and a diameter of 90 mm in its central portion has been mounted with a bell having a diameter of 31 mm at its base and a slope of 2°30 in respect of a total height of 10 mm; the height of the slits was 7 mm and the central hole of the bell had a diameter of 15 mm. The diameter of the grid hole was slightly smaller than the previous diameter.

In alternative embodiments which also come within the scope of the invention, the disc 5.1. is no longer added to and fixed on the central conductor 5 but can be integral with or soldered to said conductor.

What is claimed is:

1. An electron tube comprising coaxial cylindrical electrodes, at least one grid of pyrolytic graphite having a circular opening at the top portion thereof, a central conducting mast in coaxial relation with said electrodes and adapted to pass through said opening, a pyrolytic graphite bell having a bottom connected to the top end of said mast and a frusto-conical skirt with strips separated by slits entending from the edges of said skirt, the outer faces of said strips resting against and in electrical contact with the edge of said grid opening at a predetermined distance from the edge of the skirt, thereby providing electrical contact between said mast and said grid at the top ends thereof.

2. An electron tube according to claim 1, wherein the bottom of the bell is connected to the mast by means of an intermediate metal disc.

* * * * *